United States Patent [19]

Doi et al.

[11] Patent Number: 4,718,076

[45] Date of Patent: Jan. 5, 1988

[54] X-RAY IMAGING APPARATUS

[75] Inventors: Kunio Doi, Tokyo; Hideki Matsui; Katsuhiro Ono, both of Kawasaki, all of Japan

[73] Assignee: Kabushiki Kaisha Toshiba, Kawasaki, Japan

[21] Appl. No.: 881,573

[22] Filed: Jul. 2, 1986

Related U.S. Application Data

[63] Continuation of Ser. No. 602,422, Apr. 20, 1984, abandoned.

[30] Foreign Application Priority Data

Apr. 22, 1983 [JP] Japan ..... 58-69990
Nov. 11, 1983 [JP] Japan ..... 58-210921

[51] Int. Cl.[4] ..... G21K 5/10

[52] U.S. Cl. ..... 378/146; 378/149; 378/144; 378/7

[58] Field of Search ..... 378/7, 12, 14, 113, 378/132, 137, 144–147, 149, 154, 155, 119, 99; 358/111

[56] References Cited

U.S. PATENT DOCUMENTS

| | | | |
|---|---|---|---|
| 3,866,047 | 2/1975 | Hounsfield | 378/14 |
| 4,031,395 | 6/1977 | LeMay | 378/12 |
| 4,045,672 | 8/1977 | Watanabe | 378/137 |
| 4,087,837 | 5/1978 | Geluk | 358/111 |
| 4,114,041 | 9/1978 | Oliver | 378/7 |
| 4,179,100 | 12/1979 | Sashin et al. . | |
| 4,242,588 | 12/1980 | Silk et al. | 378/156 |
| 4,250,425 | 2/1981 | Gabbay et al. | 378/125 |
| 4,380,818 | 4/1983 | Pfeiler | 358/111 |
| 4,404,591 | 9/1983 | Bonar | 358/111 |
| 4,433,427 | 2/1984 | Barnea | 378/146 |
| 4,549,307 | 10/1985 | Macovski | 378/7 |

FOREIGN PATENT DOCUMENTS

| | | | |
|---|---|---|---|
| 2452166 | 5/1976 | Fed. Rep. of Germany | 378/154 |
| 3021757 | 12/1981 | Fed. Rep. of Germany | 378/14 |
| 0537190 | 1/1978 | Japan | 378/146 |
| 0018964 | 2/1978 | Japan | 378/147 |
| 0132985 | 11/1978 | Japan | 358/111 |
| 0006490 | 1/1979 | Japan | 378/12 |
| 54-96986 | 7/1979 | Japan | 378/125 |
| 82/01124 | 4/1982 | World Int. Prop. O. | 378/14 |
| 1528574 | 10/1978 | United Kingdom | 378/19 |

OTHER PUBLICATIONS

"Definition and Measurement of Means of Filtered X-Radiation" by Grudskii et al., Pribory i Tekhnika Eksperimenta, No. 4, Jul.–Aug. 1974.

*Primary Examiner*—Craig E. Church
*Assistant Examiner*—John C. Freeman
*Attorney, Agent, or Firm*—Cushman, Darby & Cushman

[57] ABSTRACT

An X-ray imaging apparatus comprising an X-ray generator having a cylindrical rotating target, a slit plate having a slit extending in a direction perpendicular to the direction in which an X-ray focal point moves on the target, the slit plate and rotating target being moved relatively in a direction perpendicular to the direction in which the slit extends, an X-ray detector arranged opposite to the slit plate with an object interposed between them and serving to convert X-ray beams passing through the slit and the object to electrical signals, a signal processor for picking up only those signals which relate to the object from these electrical signals obtained through the X-ray detector, and a display device for displaying an X-ray image which corresponds to the signals picked up by the signal processor.

9 Claims, 32 Drawing Figures

FIG. 4AII
FIG. 4BII
FIG. 4CII
FIG. 4DII
Q
V1
V2
V3
V4
H
X-RAY SIGNAL LEVEL
V

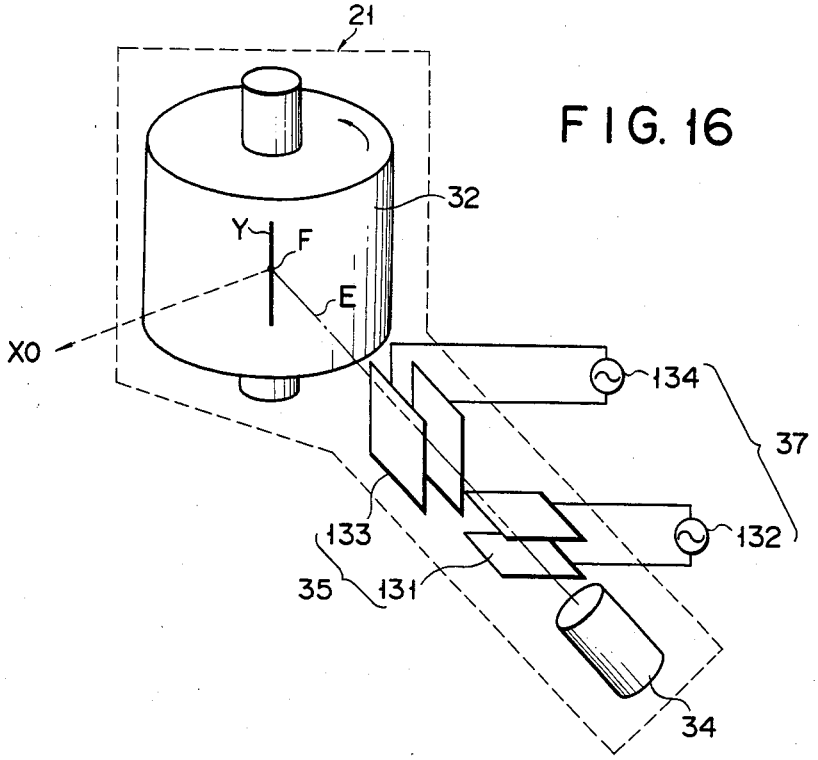
FIG. 16
FIG. 17
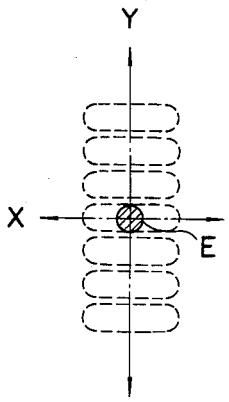
FIG. 18
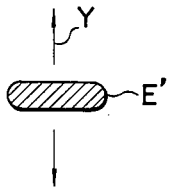

X-RAY IMAGING APPARATUS

This is a continuation of application Ser. No. 602,422, filed Apr. 20, 1984, which was abandoned upon the filing hereof.

BACKGROUND OF THE INVENTION

The present invention relates to an X-ray imaging apparatus suitable for use in medical diagnosis.

When medical radiography is carried out using the conventional X-ray imaging apparatus, the resolution and contrast of the reproduced image are likely to be degraded because of scattered X-rays generated from the object to be imaged. A demand for a high-speed X-ray imaging apparatus which enables a short exposure time has arisen these days. The amount of irradiated X-rays must be increased to achieve a high speed operation. However, there is a limitation on increasing the amount of X-rays, because an X-ray generator has a limited load.

Accordingly, Japanese Patent Disclosure (KOKAI) No. 53/7190, for example, discloses an X-ray imaging apparatus including an X-ray generator of the electronic beam scanning type which serves to move the X-ray irradiating position of an X-ray generating target, which has a slit plate positioned between the X-ray generator and the object to be imaged, which has substantially a single slit through which X-rays are allowed to pass, and which has an X-ray image detector positioned behind the slit plate to reproduce the X-ray image which is formed after X-rays pass through the slits and the object. In the case of this type of X-ray imaging apparatus, however, it is difficult to obtain a sufficient amount of X-rays and thus high S/N (signal to noise ratio) because the X-ray generator is of the stationary target type. It is also difficult to achieve high resolution because the X-ray detecting characteristic is discontinuous.

U.S. Pat. No. 4,179,100 discloses an apparatus wherein an X-ray image is reproduced in such a way that an X-ray beam which has passed through a single slit of a slit plate is further passed through an object to be imaged, and then is introduced into an X-ray detector such as a fluorescent screen or an X-ray image intensifier to be converted to an optical image. However, the object, slit plate, X-ray generator and the like are mechanically moved. In this case, it is necessary to move them over a wide range of length in order to image the whole area of the object. Thus, it is difficult to achieve a high speed operation or a short exposure time. In addition, blur is still left in the reproduced X-ray image because of scattered X-rays generated in the object and because of veiling glares generated in the image intensifier by the scattered rays and the discharging of undesired floating electrons, thereby making it difficult to achieve a satisfactory resolution and contrast.

SUMMARY OF THE INVENTION

The present invention is therefore intended to eliminate the above-mentioned drawbacks.

The object of the present invention is to provide an X-ray imaging apparatus wherein a high speed operation is made possible, wherein scattered X-rays in an object can be controlled and, whereby images having high resolution, high S/N and contrast can be produced.

According to the invention, there is provided an X-ray imaging apparatus comprising: an X-ray generator including an electron gun for emitting an electron beam, a rotating cylindrical target for receiving an electron beam emitted from the electron gun and irradiating X-rays, and a deflection means for moving an electron beam of said electron gun on the target along the axis thereof; a slit plate separated by a certain distance from the X-ray generator and having an elongated slit extending in a direction perpendicular to the direction in which an X-ray focal point moves following the movement of said electron beam, to allow X-rays to pass therethrough; an X-ray image detector means arranged opposite to the slit plate with an object to be imaged interposed between them and serving to convert X-ray images created by the X-ray beams which have passed through the slit of said slit plate and the object, to electrical signal images; a signal processing means for picking up those signals from the electrical signal images obtained through the X-ray image detector means which correspond to X-ray images entering into areas on said X-ray image detector means when the slit is projected from positions of the X-ray focal point on said target; and an X-ray image reproducing means for displaying image signals processed by said signal processing means and obtained corresponding to the X-ray images.

According to the invention, there is further provided an X-ray imaging apparatus comprising: an X-ray generator including an electron gun for emitting electron beam, an anode target for receiving the electron beam emitted from the electron gun to irradiate X-rays, and a deflection means for moving the electron beam of said electron gun on the target along the axis thereof; a slit plate separated by a certain distance from the X-ray generator and having a plurality of elongated slits each extending in a direction perpendicular to the direction in which an X-ray focal point moves following the movement of said electron beam, to allow X-rays to pass therethrough; an X-ray detector means arranged opposite to the slit plate with an object to be imaged interposed between them and serving to convert X-ray images created by the X-ray beams which have passed through the slits of said slit plate and the object, to electrical signal images; a signal processing means for picking up those signals from the electrical signal images obtained through the X-ray image detector means which correspond to X-ray images entering into areas on said X-ray image detector means when the slits are projected from positions of the X-ray focal point on said target; and an X-ray image reproducing means for displaying image signals processed by said signal processing means and obtained corresponding to the X-ray images.

There is still further provided an X-ray imaging apparatus comprising:

an X-ray generator including an electron gun for emitting an electron beam and a stationary anode target for receiving the electron beam emitted from the electron gun to irradiate X-rays;

a slit plate separated by a certain distance from the X-ray generator and having a plurality of elongated slits, the slit plate being moved in a direction perpendicular to the direction in which the plurality of slits extend;

a X-ray detector means arranged opposite to the slit plate with a subject to be imaged interposed between them and serving to convert X-ray images created by the X-ray beams which have passed through the slits of said slit plate and the subject, to electrical signal images;

a signal processing means for picking up those signals from the electrical signal images obtained through the X-ray image detector means which correspond to X-ray images entering into areas on said X-ray image detector means when the slits are projected from the position of the X-ray focal point on said target; and an X-ray image reproducing means for displaying image signals processed by said signal process means and obtained corresponding to the X-ray images.

BRIEF DESCRIPTION OF THE DRAWINGS

FIG. 16 shows grammatically a construction of the X-ray generator in the embodiment of FIG. 10;

FIG. 17 shows how electron beam scanning is conducted by the generator in FIG. 16; and FIG. 18 shows the cross section of the electron beam in FIG. 17.

DETAILED DESCRIPTION OF THE PREFERRED EMBODIMENTS

Figure 1:
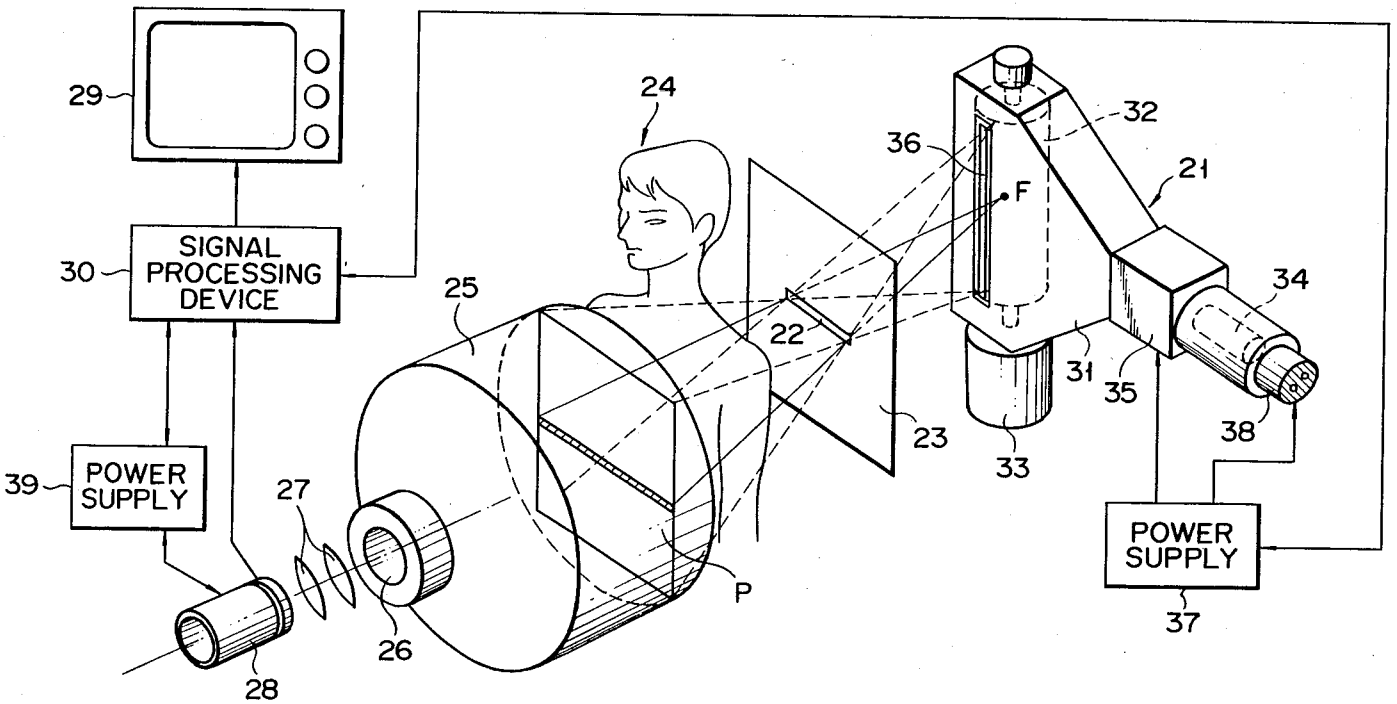
FIG. 1 is a perspective view showing an example of the X-ray imaging apparatus according to the present invention.
Figure 2:
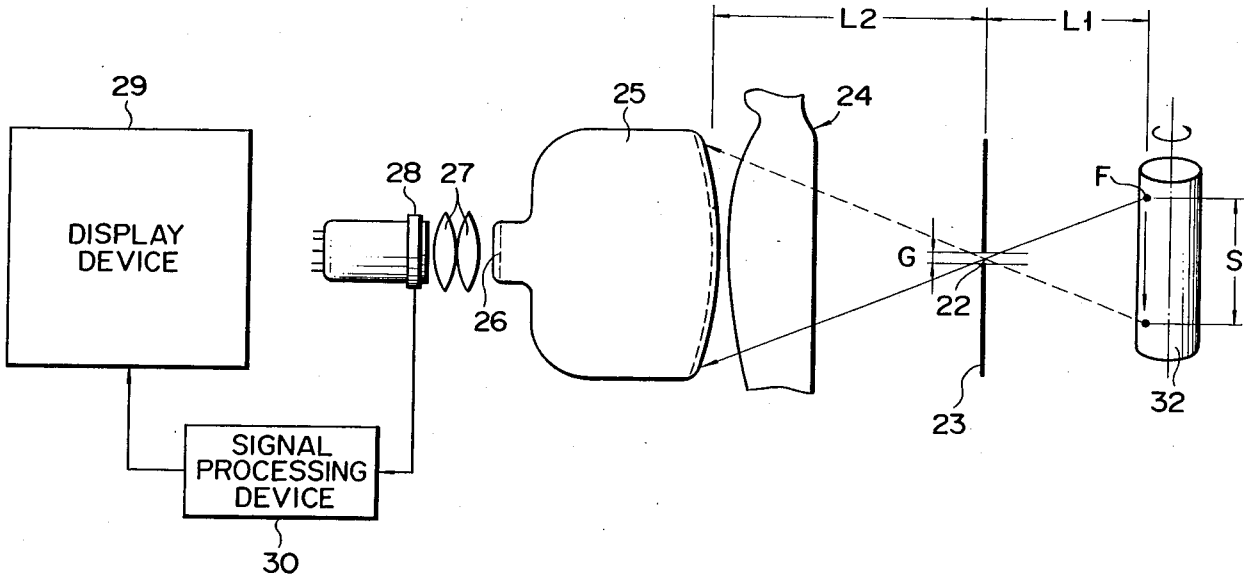
FIG. 2 is a side view showing the X-ray imaging apparatus in FIG. 1.

As shown in FIGS. 1 and 2, an example of an X-ray imaging apparatus according to the present invention comprises: an X-ray generator 21; a collimator or slit plate 23 separated by a certain distance from the X-ray generator 21 and having slits through which X-rays from the X-ray generator are allowed to pass; an X-ray image intensifier (or X-ray I.I.) 25 arranged facing the slit plate 23 with the subject or object 24 to be imaged interposed between them; a camera tube 28 for picking up the image through an optical lens system 27, said image then appears on an output screen 26 of the X-ray I.I. 25; and a signal processing means 30 for processing signals from the image obtained by the camera tube 28 and for applying these signals to reproduce the image on either a display means 29 and/or a recording means (not shown). The X-ray I.I. 25, lens system 27 and camera tube 28 form an X-ray image detector which serves to convert the X-ray image to electrical signals.

The X-ray generator 21 includes a cylindrical anode target 32 housed in a vacuum container 31 which is rotated by a drive motor 33, an electron gun 34 arranged facing the cylindrical target 32 to generate an electron beam, and an electromagnetic deflection coil means 35 for deflecting the electron beam of the electron gun 34 in such a way that the electron beam (focused by an focusing device, not shown) scan the cylindrical target 32 while remaining substantially parallel with its rotating shaft. The vacuum container 31 is provided with an elongated X-ray irradiating window 36 extending in the longitudinal direction of the target 32, and is positioned between the target 32 and the slit plate 23. The X-ray beam is irradiated from that portion of the cylindrical target 32 in which the electron beam is irradiated from the electron gun 34, thus passing through the X-ray irradiating window 36. The X-ray generator 21 receives power and is energized by a power source 37 through a high tension cable 38. Deflection power is also supplied from the power source 37 to the deflection coil 35. The position of the X-ray focal point or X-ray emitting point (F) which corresponds to the irradiated point of the electron beam on the target 32 is supplied, in the form of electrical signals, to the signal processing means 30.

The slit plate 23 is a thin plate made of heavy metal such as lead, for example, and is provided with a slit 22. The slit 22 may be made by partially cutting away the slit plate 23, or by covering the slit 22 thus formed with a metal, such as aluminium or beryllium, through which X-rays can pass with ease. The slit plate 23 is arranged so that its slit 22 is perpendicular to the direction in which the X-ra focal point (F) is moved. The X-ray I.I. 25 serves to convert an incoming X-ray image to an amplified optical image and has an input screen (P) which can sufficiently cover that part of the subject to be imaged. The X-ray I.I. 25 receives the X-ray beam which has passed through the slit 22 on its input screen (P), and displays on its output screen 26 the amplified optical image which corresponds to the X-ray beam received. The camera tube 28 is provided with a light conductive target, and is preferably energized by the current already supplied. The image signal reading position of the camera tube 28 is commanded by a signal applied from the signal processing means 30 so that the camera tube 28 can read image signals from this commanded position. Read image signals, as well as the commanded position information, are supplied to the signal processing means 30 through a signal electrode from the camera tube 28.

The signal processing means 30 receives signals which show the X-ray focal positions of the X-ray generator 21, receives signals picked up by the camera tube 28, and receives signals which show the reading positions of the picked up signals. The signal processing means 30 then causes a spatial filter (which will be described later) to eliminate degraded components which are caused by scattered X-rays in the object. The signal processing means 30 also generates signals which correspond to the X-ray image and applies them to a cathode ray tube display means 29 which displays the received signals as an X-ray image. The signals may be applied to and recorded by a recording means (not shown) instead of being displayed by the display means 29. The signal processing means 30 also has the function of controlling the scanning area by the camera tube 28 according to the position of the X-ray focal point (F).

The cylindrical target 32 in the X-ray generator 21 is rotated by the drive motor 33. The electron beam emitted from the electron gun 34 is deflected by the deflection coil means 35 to move relative to the target 32 in a direction substantially parallel to the axis of the target 32. X-rays are emitted from that point of the target on which the electron beam is irradiated. Since the electron beam moves, as described above, on the target 32 in a direction parallel to its axis, the X-ray focal point (F) also moves in a same direction.

Referring to FIG. 2, when a human body whose chest is, for example, about 40 cm wide is to be imaged, the distance (S) which the X-ray focal point (F) moves on the cylindrical target 32 is 30 cm; the electron beam draws on the target 32 an oval having a shorter diameter of 0.5mm and a longer diameter of 2.5 mm; and the effective X-ray focal point (F) draws a circle having a diameter of 0.5 mm when viewed from the slit 22.

If the width (G) of the slit 22 is 0.34 mm and its length is 17 cm, the effective diameter of the input screen of the X-ray I.I. 25 is about 57 cm. The distance (L1) between the moving line of the X-ray emitting point at the section of the X-ray generator 21, and the slit plate 23 is about 65 cm. The distance (L2) between the slit plate 23 and the X-ray II 25 is about 87 cm. The number of horizontal scanning lines on the camera tube 28 and on the display means 29 is about 1,024. When the moving line of the X-ray focal point is electrically scanned one time, image signals for each frame of the image relating to the human body are obtained. The size and shape of the X-ray focal point (F) at the section of the X-ray generator 21 are not limited to the above. For example, the electron beam irradiated on the target 32 may draw a prolate ellipsoid having a shorter diameter 0.5 mm and a longer diameter of 12.5 mm; the effective X-ray focal point may draw an oval having a shorter diameter of 0.5 mm and a longer diameter of 2.5 mm when viewed from the slit 22; and the shorter diameter formed by the X-ray focal point may be directed in the longitudinal direction of the slit 22. X-rays having a larger output can be obtained in this case.

Figure 3A:
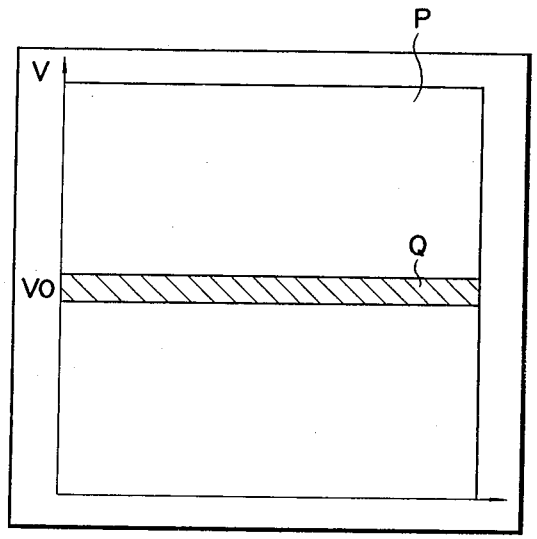
FIG. 3A shows a pattern of an area imaged by the X-ray imaging apparatus shown in FIGS. 1 and 2.
Figure 3B:
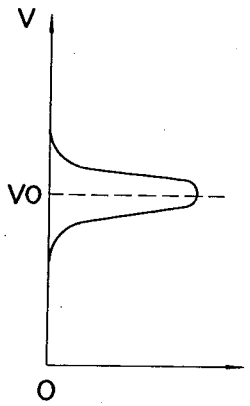
FIGS. 3B through 3D show signal waveforms relating to the signal processing of the pattern.
Figure 3C:
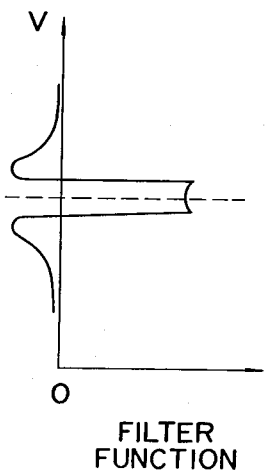

Image signals thus obtained contain a blur component because of the scattered X-rays generated in the subject to be imaged and because of the veiling glares generated in the X-ray I.I. 25 by the scattered rays and the discharging of undesired floating electrons. Referring to FIGS. 3A through 3D, FIG. 3A shows an X-ray image (Q) when an X-ray beam is irradiated onto an optional area (V0) of the entire region (P) to be imaged. The pickup signal level relating to the X-ray image (Q) in the vertical scanning direction of the electron beam of the camera tube 28 is shown in FIG. 3B.

In FIG. 3B, the signal level of the picked-up X-ray image is plotted on the abscissa and position (V) in the scanning direction of the region to be picked up is plotted on the ordinate. As shown in FIG. 3B, the picked-up signal is highest at the area position (V0), and has skirting portions on both sides of its peak value. These skirting portions represent a blur component contained in the pick-up signal which is caused by scattered X-rays and the like. The blur component must be eliminated to obtain a high accuracy image. Specifically, for the purpose of obtaining such a highly accurate image display, therefore, the blur component must be eliminated from the image signal picked up by the camera tube 28. In the case of this embodiment, the noise component or blur components is removed by the signal processing means 30 which is adapted to also serve as a spatial filter. More specifically, because the signal processing means 30 functions as a spatial filter having the filter characteristic shown in FIG. 3C, it can filter the picked-up signal. The abscissa represents the filter functions and the coordinate positions in the scanning direction in FIG. 3C. This signal filtering is made possible by the digital operational process in the signal processing means.

Figure 3D:
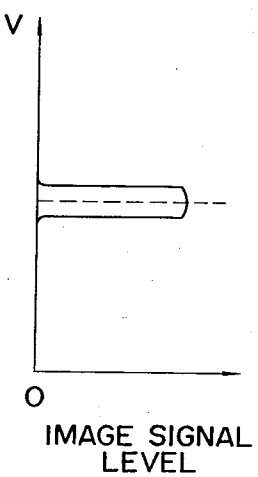

Thanks to this signal filtering, an image signal from which the blur component has been completely removed in the moving direction of the X-ray focal point (F). Therefore, only components containing no blur components can be picked up. Consequently, a high resolution and a high contrast can be obtained, as seen in FIG. 3D. The blur components are referred to as "further components" in claims 29–30. The components containing no blur components are referred to as "fundamental components" in claim 25. The abscissa represents various levels of the image signal and the coordinate positions in the scanning direction in FIG. 3D. This process is successively repeated for the entire region to be picked up. X-ray images obtained by scanning the moving line of the X-ray focal point (F) once are re-composed, thereby enabling a highly resolved and high contrast image to be displayed on the display 29. The filter function characteristic shown in FIG. 3C can be found by previously storing in the signal processing means 30 data regarding the amount of scattered X-rays and the amount of veiling glares of the X-ray I.I., expected based on the properties of the subject to be imaged and the imaging conditions, and by carrying out a predetermined operation in the signal processing means 30 on the basis of the stored data.

Generally speaking, one scan using the X-ray focal point (F) can be finished in less than 0.5 seconds, for example. One frame area may be scanned twice at a high speed (0.1 second/30 cm, for example), and the image information thus obtained may be used to reproduce an image.

As apparent from the above, X-ray imaging can be done quickly at a high speed, and an excellent image having high resolution and contrast can be obtained. Since the cylindrical target 32 is made rotatable and since the electron beam is electrically deflected to perform scanning, a large amount of X-rays can be obtained, thereby enabling high speed and an excellent S/N ratio.

In the above-described embodiment, image signals are obtained by repeating the scanning of the signal reading electron beam of the camera tube 28 on the whole of the frame in its vertical direction (V). However, it is not limited to this embodiment. It may also be arranged that image signals are picked up (for every position of the X-ray focal point) only at a specific position and its adjacent area on the frame which correspond to the position of the X-ray focal point. This system of picking up image signals only for a specific position and its adjacent area will be described referring to FIGS. 4AI through 4DI, and FIGS. 4AII through 4DII, in which the abscissa represents the levels of an X-ray signal and the coordinate positions in the scanning direction.

Figures 4A, 4B, 4C, 4D:
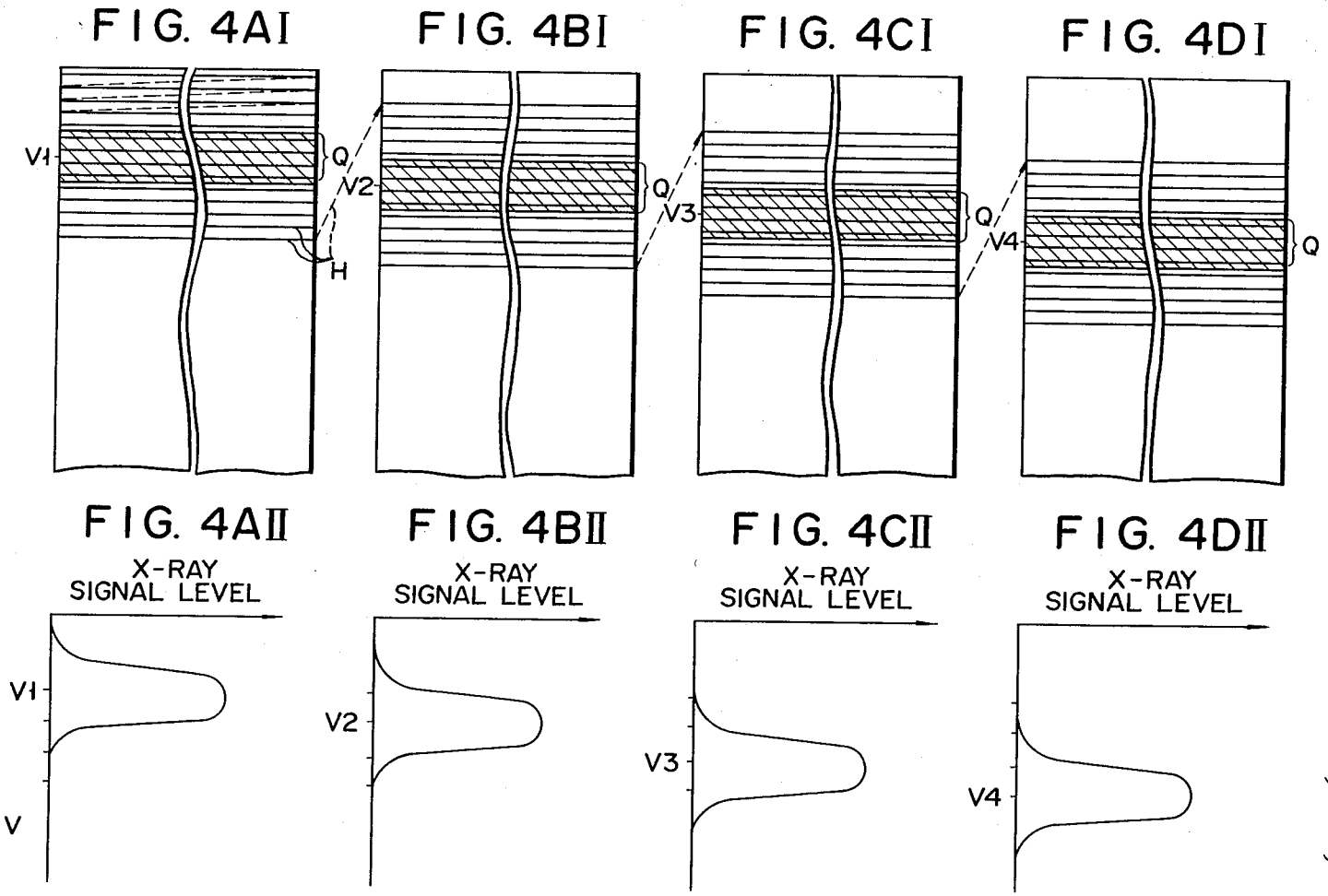
FIGS. 4AI through 4DI show the patterns of an area imaged by the X-ray imaging apparatus shown in FIGS. 1 and 2, and FIGS. 4AII through 4DII show the signal levels of these patterns.

As shown in FIG. 4AI, it is assumed that the X-ray focal point is in a position which corresponds to a position (V1) on the frame. An area (Q) onto which the X-ray beam is being projected and its adjacent area are horizontally and vertically scanned by the camera tube 28 to read out such an image signal as shown in FIG. 4AII. The image signal is processed using the above-described spatial filter function of the signal processing means 30. In the case where the X-ray focal point then moves to a position (V2), an area (Q) onto which the X-ray beam is being projected and its adjacent area are horizontally and vertically scanned in a way that is similar to that of position (V1), as shown in FIG. 4BI. The image signal shown in FIG. 4BII is obtained and filtered through the spatial filter. Thereafter, every time the position of the X-ray focal point moves to V3, V4 . . . as shown in FIGS. 4CI, 4CII, 4DI and 4DII, the same process is repeated. The image is reconstructed on the basis of the image signals thus obtained, and is displayed on the display means 29. Symbol H in FIG. 4AI represents the scanning lines of the reading-out electron beam. As will be understood, in this embodiment, area Q on which the X-rays are irradiated is scanned along a plurality of scanning lines so that the fundamental components are obtained. The signal processing which uses the spatial filter may be carried out in such a way that signals read out by the X-ray detector are temporarily stored in the signal processing means before being subjected to the filtering process.

According to the system which has been described referring to FIGS. 4AI through 4DII, read-out beam scanning may be applied for every X-ray emission to only a part of the vertically scanned region. Therefore, a sufficiently faster read-out scanning can be achieved, as compared with the moving speed of the X-ray focal point. More specifically, scanning by the read-out electron beam of the camera tube 28 is carried out at a speed sufficiently faster than the moving speed of the X-ray focal point (F) and at a position on the subject which corresponds to the X-ray focal position and on its adjacent area. The area to be scanned by the electron beam can be changed to correspond to a change in the position of the X-ray focal point. If this happens, the time necessary for taking the image can be further shortened, the amount of information relating to the image signals can be increased, and thus an X-ray image whose resolution has been further enhanced can be reproduced.

During the processing of the X-ray image, X-ray image signals may be read out only at the area onto which the slit 22 of the slit plate 23 has been projected from the X-ray focal point, thereby reproducing an image. As an example of this system, wherein the X-ray image detector is provided with a camera tube, image signals may be selectively read out only when the scanning line of the read-out electron beam of the camera tube 28 is present on an area which corresponds to the X-ray beam which has projected the slit.

The X-ray image detector is not limited to a combination of the X-ray I.I. and the camera tube as in the above-described embodiment. It may also be an X-ray I.I. which contains an output circuit for converting the output image directly to an electrical signal. Or it may be arranged that a fluorescent screen for storing energy which corresponds to the X-ray image may be used to energize image information on the screen which is read out by laser or the like and which is then converted to electrical signals.

The X-ray generator 21 will be described more concretely with reference to FIGS. 5 and 6.

The vacuum container 31 is similar in shape to a slightly flatter television cathode ray tube. The vacuum container 31 includes an enlarged portion 41 in which the cylindrical target 32 is housed. An electron emitting cathode electrode 42 which forms the electron gun 34 is also housed in the vacuum glass container 43. A cone portion 44, an air-tight connector portion 45, a ceramic or thin metal cylindrical portion 46, a bellows portion 47 and a cylindrical acceleration electrode portion 48 of the electron gun 34 are all air-tightly and successively connected with one another between the enlarged portion 41 and the container portion 43. The air-tight connector portion 45 includes a contact member arranged on the side of the cone portion 44 and another contact member arranged on the side of the cylindrical portion 46. The contact members are detachably connected, with each other by bolts 50, with an air-tight conductive packing 49 interposed between them. They are detachably arranged, as described above, for assembly, disassembly, or reassembly. Electromagnetic deflection coils 35 for deflecting electron beams are arranged outside the cylindrical portion 46. The inner face of the cylinder 46 is covered with a thin conductive film such as carbon so as to cause almost no eddy-current loss because of deflected magnetic field. The bellows portion 47 is intended to achieve micro-adjustment between the central axis of the electron gun 34 and the axis of the enlarged portion 41. An electromagnetic focusing coil 51 for the electron beam is fitted onto the acceleration electrode portion 48. An assembly including the coils 35 and 51 is covered with a cylindrical metal cover 52 and is connected to the ground. An insulating oil container 53 is arranged around the glass container 43 and is fixed to a flange of the vacuum container by bolts 55. An insulating cylindrical receptacle 56 is plugged in one end of the insulating oil container 53 to connect a high voltage cable (which corresponds to the one represented by numeral 38 in FIG. 1) thereto. Lead lines extending to a cathode 42 are connected to connecting terminals 57 arranged in the receptacle 56. The cathode 42 applies a high negative potential to the grounded vacuum container. The container 53 is filled with insulating oil, and is connected to an external cooler (not shown) through a pipe, thereby enabling the oil to be circulated into the container 53 through the cooler. An ion pump 59 is connected to the cone portion 44 of the vacuum container. A discharging pipe 61 which is connected to a discharge means 60 shown by a broken line is branched from the duct which extends to the ion pump 59.

Figure 7:
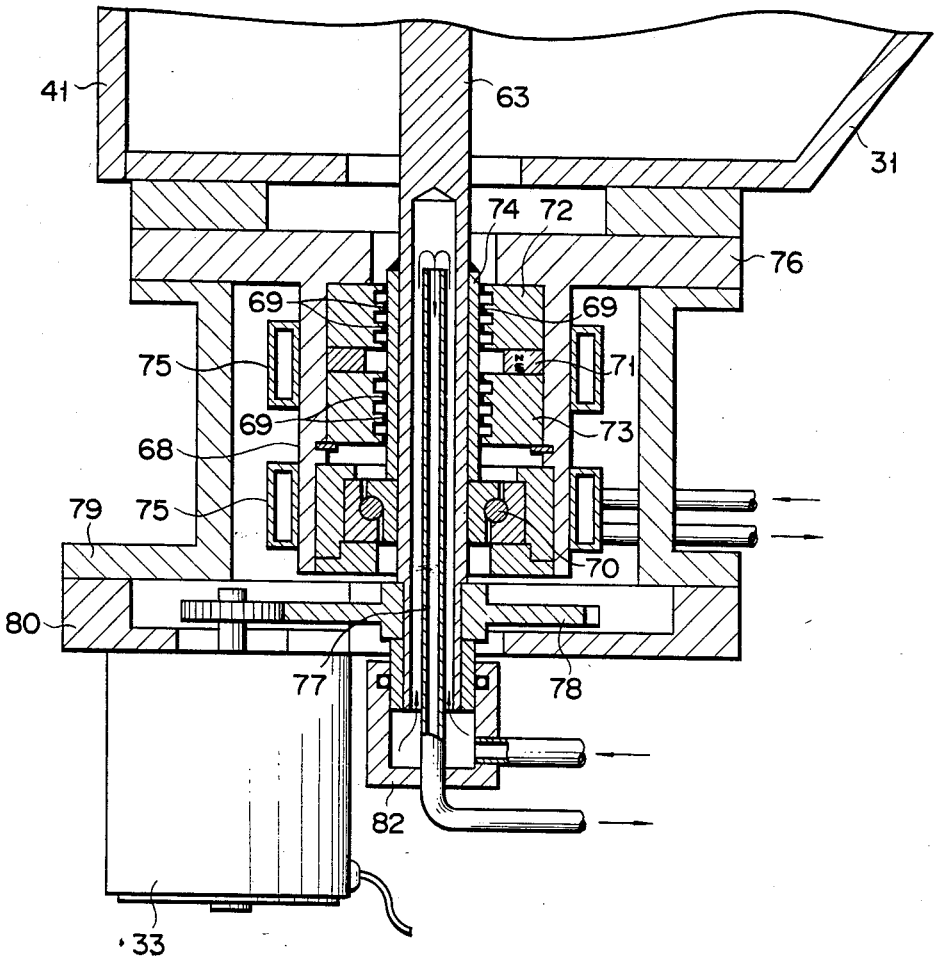
FIG. 7 shows in detail a part of the X-ray generator in FIG. 5.

The cylindrical anode target 32 is a column made of a heavy metal such as tungsten (W) having a high melting point. Both ends of the target 32 ar rotatably supported in the enlarged portion 41 of the vacuum container 31 by means of support arms 62, 63 and bearings 64, 68. The upper bearing 64 is arranged in an air-tight vacuum cap 65 having a bolt-screwed flange 66, and is supported by two ball bearings 67. The other lower bearing 68 is supported by a magnetic seal 69 which has ball bearings 70 arranged on the outside, as shown in FIG. 7. The magnetic seal 69 includes a permanent magnet 71, magnetic poles 72, 73 each made of a ferromagnetic material, and a ferromagnetic cylinder 74 fixed onto the support arm. Magnetic liquid is present in a micro-clearance between these magnetic poles 72, 73 and the cylinder 74, thereby providing vacuum air-tightness. The ball bearings 70 are arranged outside or on the atmospheric side of the magnetic seal 69 to become integral with the magnetic seal 69. The angular-contact bearing is employed as the ball bearing 70 because it must mechanically support the heavy and large cylindrical target 32. As apparent from the above, vacuum air-tightness can be held by the inner magnetic seal 69 while the weight of the cylindrical target 32 can be supported by the ball bearings 70 arranged on the atmospheric side. These bearings are forcedly cooled from the outside by cooling pipes 75 and are mechanically fixed to the vacuum container 31 through a flange 76. That portion of the support arm 63 around which the bearings are arranged is made hollow so as to allow a cooling medium circulating pipe 77 to be inserted thereinto. The cooling medium is introduced and discharged, as shown by arrows, to circulate through the pipe 77, thereby preventing the magnetic seal 69 from being overheated while enabling heat from the target 32 to be discharged outside. The cooling medium passes through that portion of the pipe 77 which corresponds to the magnetic seal 69 and then through the portion which corresponds to the target 32 before being discharged. A gear 78 is connected to the support arm via a drive motor 33 to rotatably drive the support arm. The motor 33 is mechanically fixed to the vacuum container 31 through a support frame 79 and a fixing flange 80. Numeral 82 represents a jacket for the cooling medium.

An elongated X-ray irradiating window 36 is arranged adjacent to the cylindrical target 32 in the vacuum container 31. The X-ray irradiating window 36 is formed by a thin plate of beryllium or titanium and is held air-tightly by a window frame 81. The cylindrical target 32 is rotated at a predetermined speed by means of a motor and receives the impact of the deflected scanning electron beam (E) to shoot X-rays. The electron beam (E) is irradiated through the deflection coil to a position on the cylindrical target 32 which is slightly separated from the center axis (O) of the target 32, and X-rays are shot from this focal point. The reason why the electron beam (E) is irradiated to that position on the cylindrical target 32 which is slightly separated from the center axis thereof is so that the projected electron beam can draw a true circle when the target 32 is viewed from the X-ray irradiating window or from the slit plate 23 at the time when the electron beam (E) strikes the target 32. Therefore, the electron beam (E) is irradiated on the cylindrical target 32 in such a way that its projected shape becomes a true circle when viewed from the X-ray irradiating window 36, thereby enabling a small X-ray focal point (F) to be formed with a sufficiently intense electron beam.

According to the X-ray generator 21 having such an arrangement as described above, the electron beam scans the rotating cylindrical target 32, but remains parallel with the axis of the target to shoot X-rays. Accordingly, a sufficiently large amount of X-rays can be obtained, and the X-ray focal point (F) can be moved at high speed. In addition, the integral combination of the inner magnetic seal 69 and the outer ball bearings 70, which is used to support the cylindrical target 32, enables a sufficient amount of air-tightness to be held so that large and heavy targets can be supported stably while being rotated at high speed. Further, the inside of the vacuum container can be held to a pressure less than $1\times10^{-7}$ torr thanks to the magnetic seal 69. Furthermore, the ball bearings 70 can be used on the atmospheric side, with lubricating agent being supplied, so that a large and heavy target can be operated at high speed over a long period of time. Heat generated from the target 32 is discharged to the outside as it is irradiated to the wall of the vacuum container. For the purpose of increasing this heat irradiation, the inner wall of the vacuum container may be colored black, or heat radiating fins or cooling pipes may be arranged around the vacuum container to forcefully cool it.

Figure 5:
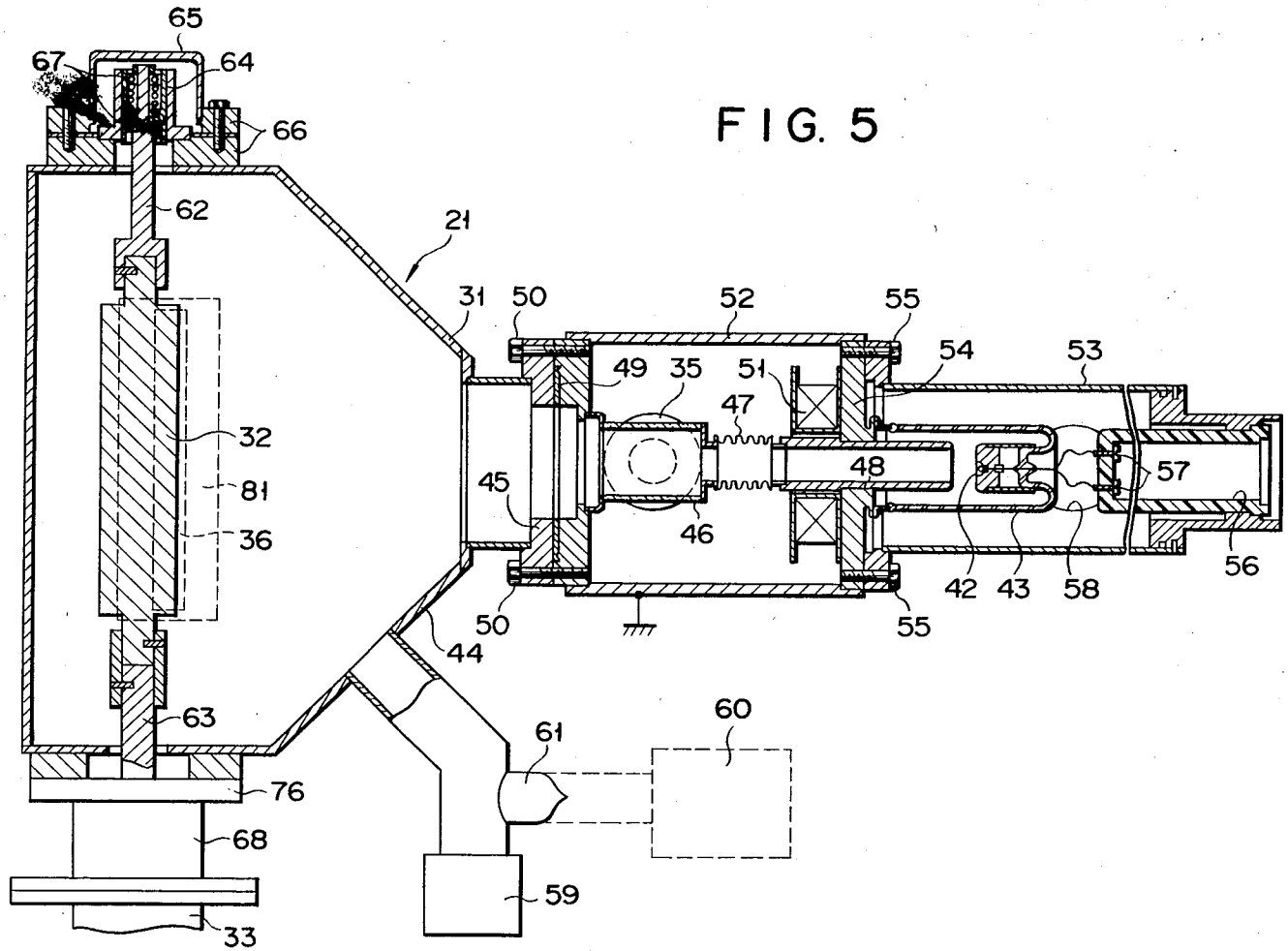
FIG. 5 is a sectional view showing an X-ray generator incorporated in the X-ray imaging apparatus shown in FIGS. 1 and 2.
Figure 6:
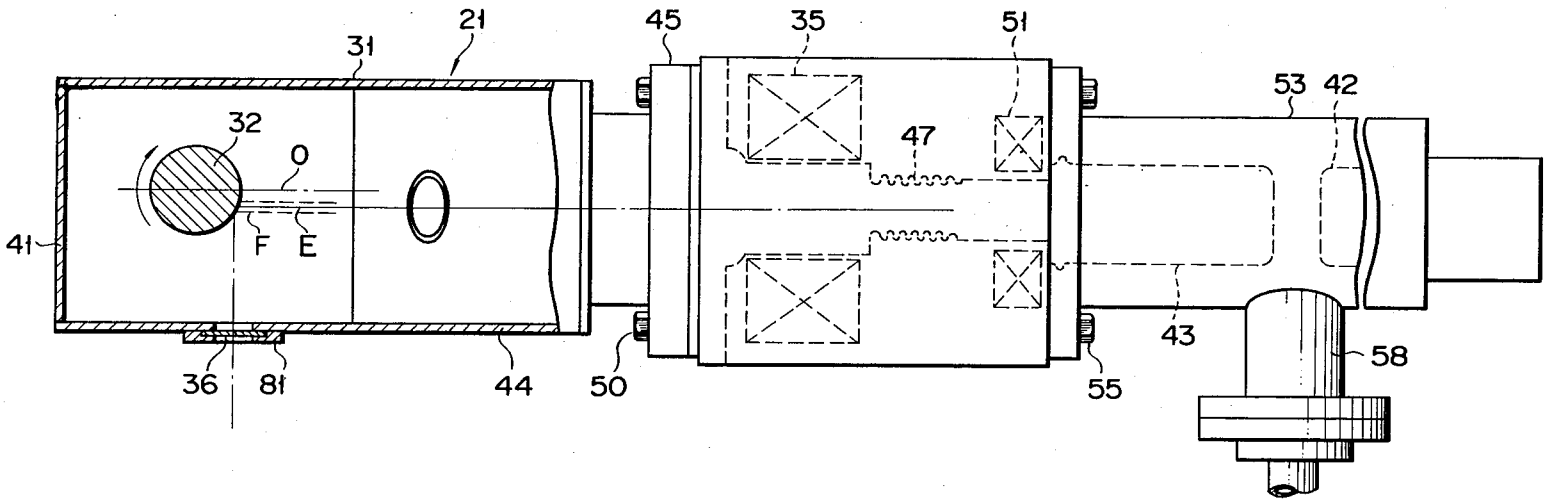
FIG. 6 is a more simplified view similar to FIG. 5, but viewed from the top of the apparatus shown in FIG. 5.

As shown in FIG. 5, the X-ray generator 21 having the arrangement described above is well suited for the bearings 68 and 64, where the bearing 68 which is an integral combination of the magnetic seal and the ball bearings is located on the underside, and where the ball bearing 64 which is arranged in the vacuum inside the air-tight cap 65 is located on the top. More specifically, the bearing located on the underside serves to support the weight of the target by means of the ball bearings arranged in the atmosphere while keeping the vacuum in the container air-tight by means of the magnetic seal. On the other hand, the other bearing located on the top is similar to those used in the conventional X-ray tube of rotary anode type since it serves only to prevent the support arm from being deflected. The integral combination of the magnetic seal and the ball bearings may be used as the bearing located on the top. Therefore, a relatively large and heavy cylindrical target can be rotated at high speed, the X-ray focusing point can be moved to achieve scanning at a desired speed, and high speed X-ray photography can be carried out.

Figure 9:
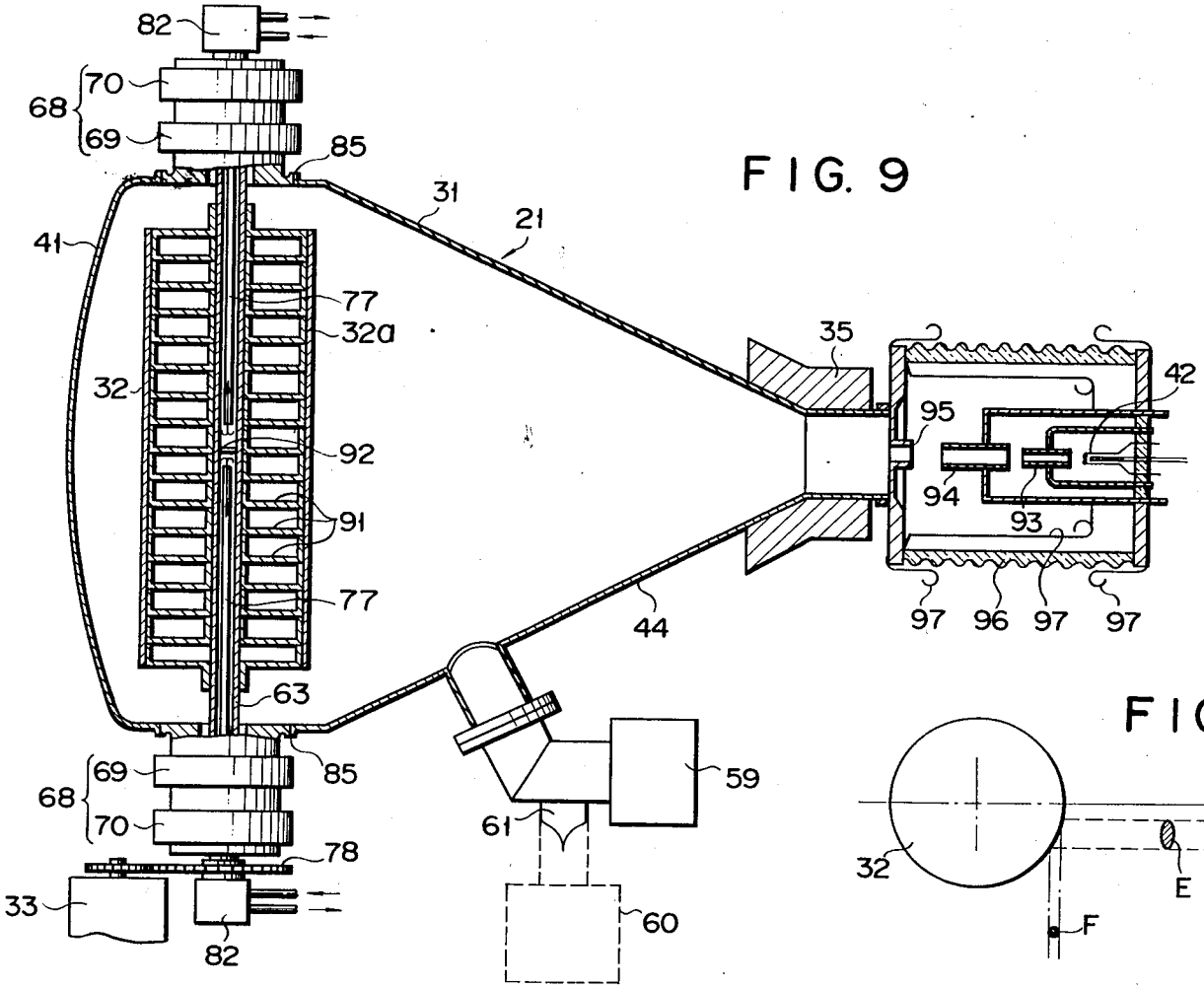
FIG. 9 shows another example of an X-ray generator.
Figure 8:
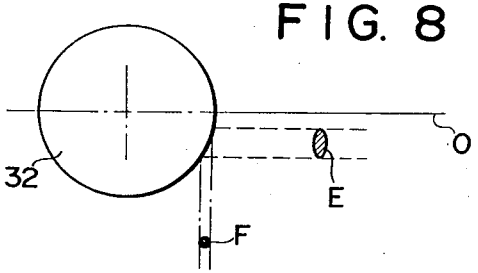
FIG. 8 is a top view showing a target incorporated in the X-ray generator in FIGS. 5 and 6 wherein a incoming electron beam and outgoing X-ray beam is shown in section.

Another X-ray generator 21 shown in FIG. 9 has a cylindrical target 32 comprising a plurality of spacers 91 which are piled one upon the other around the support arm or shaft 63. A heavy metal target layer **32*a* is coated over the outer surface of the piled spacers 91. The cylindrical target 32 is therefore allowed to have a larger diameter without increasing its weight. Some of the heat is transmitted from the target layer to the support shaft 63 through the spacers 91, while the remaining heat is transmitted to the vacuum container due to radiation, thereby balancing the distribution of heat over the whole of the X-ray generator. The bearing 68 which is similar to the one shown in FIG. 7 and which is an integral combination of the magnetic seal 69 and the ball bearings 70 is used at both ends of the support shaft 63. The support shaft 63 is hollow and is divided at its center by a partition plate 92. The cooling medium circulating pipe 77 is inserted into each of these hollow portions so as to circulate a cooling medium through the pipe as shown by the arrows. The drive motor 33 is connected to one end of the support shaft 63 through the gear 78. The cooling medium introduced from outside cools the magnetic seal portion 69 at first, enters into the target to absorb heat, and is finally discharged to the outside from the jacket 82 through the pipe 77. The temperature of the magnetic seal 69 is usually kept low due to the flow of this cooling medium, thereby enabling the vacuum and air-tight condition to be kept reliably. In addition, this cooling system also serves to cool the cylindrical target 32 so that the entire X-ray generator can be simplified in construction. The pair of upper and lower bearings 68, 68 is fitted into an opening of the vacuum container 31 at its flange portion and is air-tightly welded and fixed thereto at its arc welded portions 85, 85. The electron gun 34 comprises a cathode 42, a plurality of cylindrical electrodes 93, 94, and an acceleration electrode 95 arranged before the cathode 42 to form an electrostatic focus lens. These cathode and electrodes are arranged inside a ceramic insulating container 96. Numeral 97** represents a corona discharge preventing ring.

This X-ray generator 21 has the same functions as that of the already-described first example of an X-ray generator, with the additional function that it allows the weight of the target to be reduced. In addition, the bearing, which is an integral combination of the magnetic seal 69 and the ball bearings 70 arranged outside the magnetic seal 69, is used at both ends of the target 32. Therefore, the X-ray generator 21 can be settled both in the vertical and horizontal directions thus making its vacuum and air-tightness as well as its mechanical support to remain stable.

Figure 10:
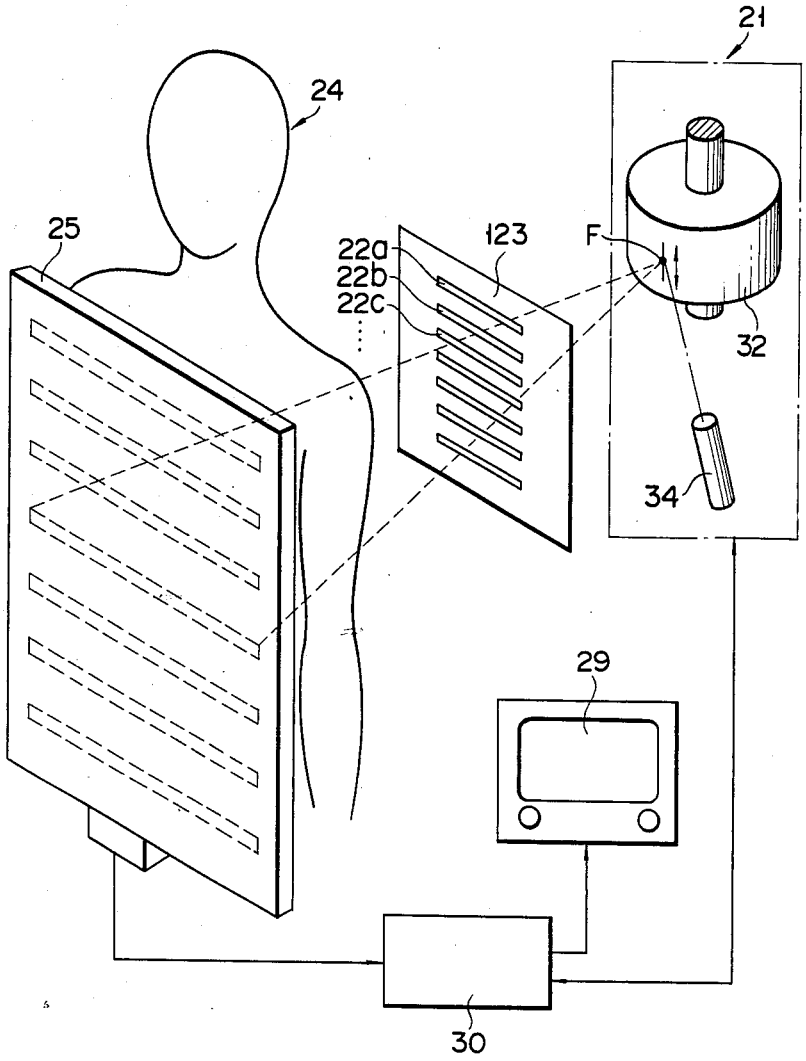
FIG. 10 shows another embodiment of the present invention.
Figure 11A:
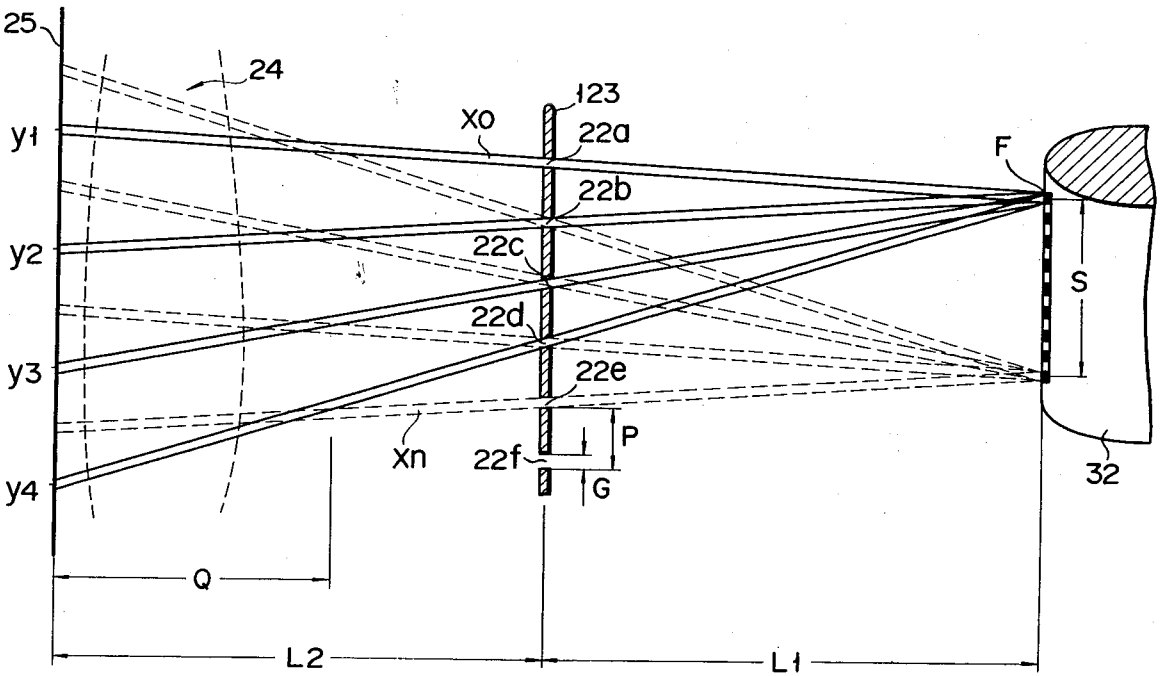
FIGS. 11A and 11B are views showing the side of the apparatus in FIG. 10, and the image areas on the X-ray detecting surface in the vertical direction thereof.

FIG. 10 shows another embodiment of the present invention. This embodiment is similar to the first one except that a slit plate 123 provided with a plurality of parallel slits *22a, 22b, 22c* . . . is employed instead of the slit plate 23 provided with only one slit 22. The same parts as those in the first embodiment will be represented by the same reference numerals, but a description of these parts will be omitted. The anode target 32 may be of a rotating type as in the first embodiment or of a stationary type. When it is of a rotating type, it is made to be cylindrical, but when it is of a stationary type, it may serve only to irradiate the X-ray beam in a certain direction at the time when electron beam is moving. The target 32 may be a disc because the moving distance of the X-ray focal position may be small. As in the first embodiment, the slit plate 123 has slits *22a, 22b, 22c* . . . perpendicular to the direction in which the X-ray focal point (F) is moved on the target 32. The slit plate 123 is a flat plate of heavy metal such as lead, 2 mm thick, for example, and the slit width (G) and the pitch distance (P) of these slits *22a, 22b, 22c* . . . are 0.2 mm and 2 mm, respectively. A hundred slits, for example, can be formed in the slit plate 123. In FIG. 11A, however, only six slits *22a, 22b, 22c, 22d, 22e* and *22f* are formed for the sake of clarifying the drawing. Similar to the case of the first embodiment, each of the slits *22a, 22b, 22c* . . . may be made either as a through-hole, or as a through-hole which has been filled with a metal, such as aluminium or beryllium, which has a high X-ray transmittance.

When it is assumed that the X-ray focal position (F) is located at the top of an X-ray focal distance (S) on the rotating target 32, those X-rays which have passed through the slits *22a, 22b* . . . after being emitted toward the slit plate 123, further pass through the subject 24 to be imaged, and enter the image intensifier 25 after being modulated by the subject 24. The image intensifier 25 converts the entered X-ray image to an intensified optical image. The converted optical image is detected by the detector (which is similar to the one 22 shown in FIG. 1). The optical images obtained by the X-ray I.I. 25 correspond to electrical signal images obtained by the detector which includes the X-ray I.I. 25, the lens system 27, and the camera tube 28 of FIG. 1. In the following description which will be made referring to FIGS. 10 and 11A, therefore, optical images A11, A12, A13, A14, A21, A22, A23, A24 . . . obtained by the X-ray I.I. 25 will be used as electrical signal images obtained by the detector.

When a human body whose chest is, for example about 40 cm wide is to be imaged, the distance (S) which the X-ray focal point (F) moves on the cylindrical target 32 is 4 mm; the electron beam draws on the target 32 an oval having a shorter diameter of 0.4 mm and a longer diameter of 2.5 mm, and the effective X-ray focal point (F) draws a circle having a diameter of 0.4 mm when viewed from the slits *22a, 22b, 22c* . . . A hundred slits *22a, 22b, 22c* . . . are formed in the slit plate 123. The slits *22a, 22b, 22c* . . . are parallel one another. The width (G) of the slits *22a, 22b, 22c* . . . is 0.2 mm, the thickness is 2 mm and the pitch is 2 mm the effective diameter of the input screen of the X-ray I.I. 25 is about 57 cm. The distance (L1) between the moving line of the X-ray focal point at the section of the X-ray generator 21, and the slit plate 123 is about 1 m. The distance (L2) between the slit plate 123 and the X-ray I.I. 25 is about 1 m.

Figures 12A, 12B, 12C, 12D:
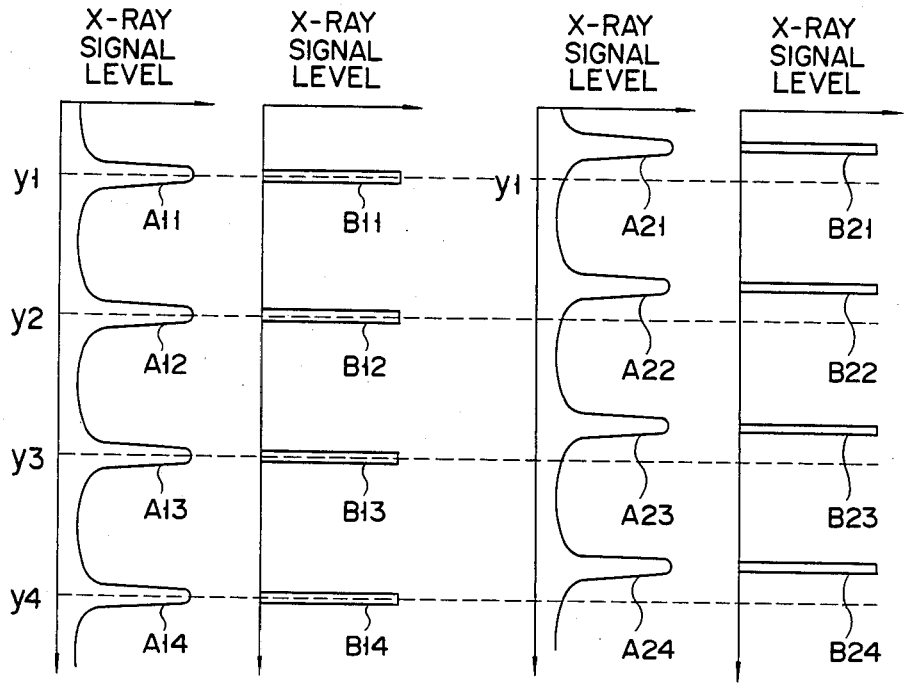
FIGS. 12A through 12D show levels of the signals obtained by the apparatus shown in FIG. 10.

X-ray image signals, obtained by the detector in the case where the X-ray focal position (F) is located at the top of an X-ray focal line, are as shown in FIG. 12A. FIG. 12A shows the level of the image signal or the strength at each of the positions on the to-be-detected surface in the vertical direction thereof, in which the abscissa represents the image signal levels and the coordinate times. Signal All at a position Y1 in FIG. 12A corresponds to an X-ray signal at a position Y1 on the X-ray I.I. 25 shown in FIG. 11A. Similarly, signals A12, A13 and A14 at positions Y2, Y3 and Y4 in FIG. 12A correspond to X-ray image signals at positions Y2, Y3 and Y4, respectively, on the X-ray I.I. 25 shown in FIG. 11A. Low level signal components appearing at each of the positions Y1, Y2, Y3 and Y4 in FIG. 12A represent blurs caused by scattered X-rays generated in the subject to be imaged, and by veiling glares generated in the X-ray I.I 25 by undesired floating electrons and the like. As previously mentioned, in the claims, the blur components are referred to as "further components", and the components containing no blur components are referred to as "fundamental components". For the purpose of gaining a highly accurate image, it is necessary to eliminate these blur component and to pick up only those signals at the positions Y1, Y2, Y3, Y4 . . . This can be satisfied when the signals which represent the positions of the X-ray focal point of the X-ray generator 21 are coordinated with those signals which represent the positions on the to-be-detected surface onto which the X-rays are irradiated from the positions of the X-ray focal point. This signal processing can be achieved according to the conventionally well-known manner. In a case where the detector means, which is a combination of the X-ray I.I. 25 and the camera tube 28, is used as in the first embodiment, it may be arranged that X-ray images obtained by X-ray emission at every X-ray focal point are stored on the target of the camera tube 28, that the entire of the region to be picked up is scanned at least once or at least for one frame both in the horizontal an vertical direction by the read-out electron beam of the camera tube 28, and that image signals which correspond to the positions Y1, Y2 . . . are extracted from the pickup signals obtained. The blur component caused by scattered X-ray generated in the subject to be imaged, and veiling glares and the like can be eliminated substantially by this process, thereby enabling a highly resolved and contrasty image to be obtained. Image signals B11, B12, B13 and B14 shown in FIG. 12B represent the signals obtained after this signal processing.

When the X-ray focal point (F) is shifted slightly downward, X-ray signals obtained by the detector are accordingly obtained at positions Y1, Y2 . . . which are slightly shifted, as apparent from FIG. 12C where they are shown as A21, A22, A23 and A24. The X-ray signals shown in FIG. 12C are also processed like those shown in FIG. 11A to remove the blur component, so that only the image signal components B21, B22, B23 and B24 can be extracted as shown in FIG. 12D. The X-ray focal point (F) is successively moved on the scanning line (S) to the lowermost position thereof and the signal processing is repeated at every position of the X-ray focal point (F) to obtain the image signals B11 . . . B14, B21 . . . B24 . . . The image signals obtained at every position of the X-ray focal point (F) on the scanning line are stored in the signal processing means 30 and then are processed to reproduce a X-ray image of the entire subject. This reproduced image signal is applied to the display means and is displayed on it.

Figure 11B:
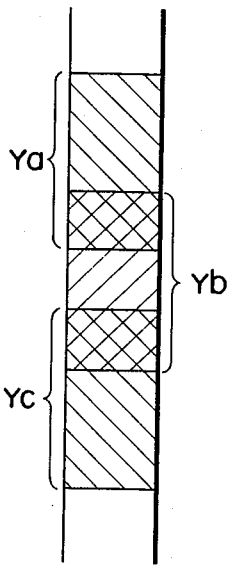

In FIG. 11A, the projected lines of the X-ray beam are shown by broken lines Xn in the case where the X-ray focal point (F) is at the lowermost position on the moving line. When the X-ray focal point (F) moves from the top to the lowermost position on the moving line (S), the image area on which the X-ray which has passed through the slit 22*a* is projected is limited to an area (Ya) in FIG. 11B. Similarly, it is limited to an area (Yb) in the case of the slit 22*b*, and an area (Yc) in the case of the slit 22*c*. Some adjacent areas overlap with each other. Speaking of signals at this overlapped area, it may be arranged that only signals obtained from the X-ray beam passing through one of the adjacent slits, that is, signals at that portion of one area which is overlapped with its adjacent area are picked up, or that signals at those portions of both adjacent areas which are overlapped with each other are composed to obtain an average value. When the arrangement of the apparatus components, and the shape and relative position of the slits are determined to partially overlap the projected image areas, as described above, all X-ray beams passing through the entire region (Q) where the object 24 is located can be irradiated on the detection surface to thereby obtain a highly accurate image.

A more accurate signal processing can be achieved when the image pickup is done once beforehand (or for more than one frame) with no object located therein. The relation between the positions of the X-ray emitting point and the signal positions which correspond to the point positions, as well as reference level values, are gained on the basis of signals obtained by the image pickup. This information is stored in the signal processing means 30. The X-ray focal point (F) may be moved continuously or in a stepped manner with a microinterval interposed.

When the moving distance of the X-ray focal point (F) is made short, the time during which an image is reproduced can be shortened accordingly. In addition, the moving distance (S) of the X-ray focal point (F) can be shortened when the number of slits is increased. Further, when the ratio (L1/L2) between distance (L1) from the X-ray focal point to the slit plate 123, and between distance (L2) from the slit plate 123 to the detection surface is made smaller, the moving distance (S) of the X-ray focal point (F) can be shortened accordingly. When the pitch interval (P) between adjacent slits is made shorter, however, blur component because of scattered X-rays generated in the object increases thereby lowering image accuracy. When the ratio (P/S) between the pitch interval (P) of the adjacent slits and the moving distance (S) of the X-ray focal point is made larger, the region (Q) where the object can be located becomes narrow. Therefore, the moving distance (S) of the X-ray focal point, distances (L1) and (L2), the pitch interval (P) between adjacent slits, and the like are appropriately determined considering the above-mentioned matters. Input power applied to this X-ray generator 21 has a voltage of 120 KV and a beam current of 50 mA, thereby enabling power consumption to be reduced to 600 KW. Accordingly, the target 32 employed can be relatively small in heat capacity. The time which is needed to finish imaging one frame can be made less than 30 msec.

The image display means 29 has a thousand horizontally scanning lines which serve as a television screen which can produce sufficient resolution and sufficient S/N. When a slit plate having a hundred slits, for example, is used, and imaging is carried out in sucn a way that a slit-projected X-ray image (A), obtained at every position following the movement of the X-ray focal point, is formed ten times between the adjacent beam positions or between positions (Y1) and (Y2), for example, so that an image on one frame can be reproduced by the hundred horizontally scanning lines. In short, image reproduction can be achieved using a large amount of image information, thereby enabling the accuracy of the image to be enhanced.

Figure 13:
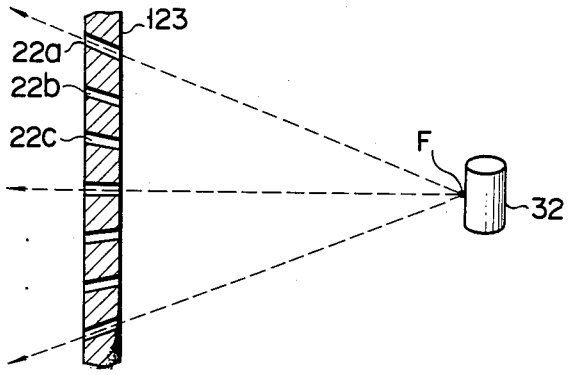
FIGS. 13, 14 and 15 are sectional views showing examples of a slit plate incorporated in the apparatus in FIG. 10.

FIG. 13 shows a further slit plate 123 wherein each of slits 22*a*, 22*b* . . . is directed to become coaxial with a line which connects the slits to the target. In the case of the slit plate shown in FIG. 13, therefore, the slope of the slits directed to the target 32 becomes deeper as they come nearer to the outer edge of the slit plate.

Figure 14:
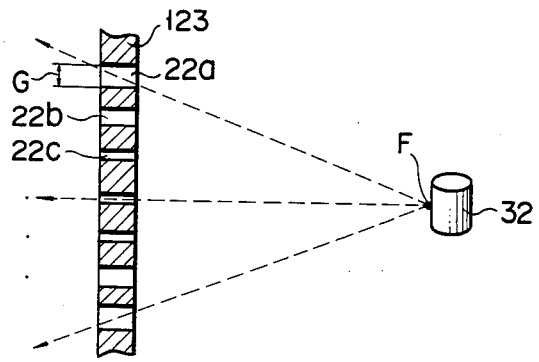

FIG. 14 shows a still another slit plate 123 wherein the width (G) of each of the slits increases as they come nearer to the outer edge of the slit plate, and whereby the width of X-rays which have passed through any one of the slits is made to be substantially equal to that of the slits.

Figure 15:
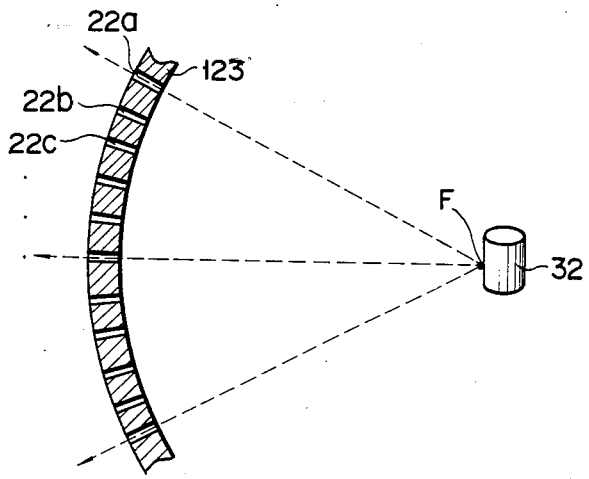

FIG. 15 shows a still further slit plate 123 wherein the whole of the slit plate 123 is bent like an arch, taking the target as its center, or using the distance from the target 28 to the slit plate 123 as its radius, and whereby the slits are directed radially, taking the target 32 as their center. The strength of X-rays which have passed through any one of the slits can be therefore made substantially equal throughout the picked-up area thereby enhancing the accuracy of the reproduced images.

FIG. 16 shows roughly the construction of the X-ray generator 21 employed in the embodiment shown in FIG. 10. This X-ray generator 21 is similar in construction to the one employed in the other embodiment shown in FIGS. 1 and 2. A portion of the deflection device is shown in detail in FIG. 16. It is preferable that the electron density of the electron beam irradiated on the target 32 at a unit area thereof is as small as possible in order to reduce the temperature rise of the surface of the target. When a focusing lens system is formed, it is also preferable that the sectional shape of the electron beam emitted from the electron gun 34 be circular. In the case of this embodiment, therefore, an electron beam (E) having a circular or a1 m ost circular section is emitted from the electron gun 34. Arranged between the electron gun 34 and the target 32 are a first electrostatic deflection electrode 131 for deflecting the emitted electron beam (E) in a direction parallel to the axis of the target 32, and a second electrostatic deflection coil 133 for deflecting the emitted electron beam (E) in a direction perpendicular to the axis of the target 32. The deflection electrodes 131 and 133 form the deflection means 35. A deflection current having sawtooth waveform and a frequency of f1, for example, is applied from a deflection power source 132 to the first deflection coil 131, while a deflection current having a sawtooth waveform or sine-waveform and a frequency of f2, for example, is applied from a power source 134 to the second deflection electrode 133. The power sources 132 and 134 form the power source means 37.

The frequency f2 of the deflection current is set at 3 KHz, for example, to be sufficiently higher than the frequency f1 of the deflection current which is set at 30 Hz, for example. Accordingly, as shown in FIG. 17 the circular electron beam (E) is reciprocated in the direction (X) at a high speed which corresponds to the high frequency f2, while moving continuously or in stepped manner in the direction (Y) at a low speed which is determined by the low frequency f1 . X-ray beam is emitted from that portion of the target 32 on which the electron beam is irradiated. Since the electron beam (E) is deflected as described above, the shape of the electron beam (E) on the target 32 at an optional instant becomes practically the same as an elongated beam shape extending in the longitudinal direction of each of the slits in the slit plate, that is, in a direction perpendicular to the axis of the target 32, as shown in FIG. 18. This means practically that the elongated beam (E') moves along the direction (Y). X-rays generated when the target 32 is irradiated by the beam (E') are brought in a direction in which the beam (E') is viewed like a circle, or in a direction Xo (to which the slits *22a, 22b* . . . of the slit plate 123 are directed perpendicularly) as in FIG. 16. Therefore, the electron beam density per unit time and area can be lowered. As deflection scanning in the direction (X) is enough to only cover a distance of 3–5 mm, it is unnecessary to use a large amount of deflection power thus enhancing the practicability of the apparatus. Further, the blur of the X-ray images obtained can be reduced. The deflection means is not limited to those of the electrostatic deflection type, but may be of the electromagnetic deflection type or a combination of these two types.

With the two embodiments as have been described, the X-ray focal point (F) is moved on the target while the slit plate is stationary. However, in the embodiment shown in FIG. 10 in which the slit plate is provided with a plurality of slits, the X-ray focal point (F) may be fixed while the slit plate may be moved along a direction perpendicular to the direction in which the plurality of slits extend. In this case, an ordinal X-ray tube of a rotating anode type may be used instead of the X-ray tube in which the electron beam is deflected, and the slit plate may be moved by 1.5 times the pitch distance (P) of the slits. In this case, a short exposure time is required for obtaining one frame of the image.

Although two embodiments have been described, they are quite similar except that the target 32 is of a rotating type and that the slit plate 32 has a single slit in the case of the embodiment shown in FIGS. 1 and 2, and that the target 32 may be either of the rotating or stationary type and that the slit plate 132 has a plurality of slits *22a, 22b, 22c* . . . in the case of the other embodiment shown in FIGS. 10 and 11A. Therefore, the description which has been made above can be applied to any of these embodiments commonly, except as it applies to the above-mentioned differences.

As apparent from the above, there can be provided an X-ray imaging apparatus wherein a high speed operation can be achieved and wherein the influence of scattered X-rays can be reduced to produce a highly resolved and contrasty image of high S/N.

What is claimed is:

1. An X-ray imaging apparatus comprising:

means for generating X-rays, including electron gun means for emitting an electron beam, anode target means for receiving the electron beam emitted by said electron gun means, and for irradiating X-rays at an X-ray focal spot on said anode target means, and means for moving said X-ray focal spot in a first direction by a first distance on said anode target means;

a slit plate, separated from said X-ray generator means by a second distance, and disposed substantially parallel to said first direction in which said X-ray focal spot moves, said slit plate formed with a plurality of elongated slits which allow X-rays to pass therethrough, and which are arranged side-by-side, each extending in a second direction substantially perpendicular to said first direction in which the X-ray focal spot moves on said anode target means, said slits being adjacent to each other and separated from each other by a third distance;

means for detecting X-rays, having a two-dimensional input plane, including a projected area, arranged opposite to said slit plate, so as to accommodate a subject to be imaged between said slit plate and said detcting means, said X-ray detecting means being separated from said slit plate by a fourth distance, said X-ray detecting means for detecting X-rays having passed through said slits and the subject and impinged on said two-dimensional input plane, and converting said X-rays into electrical signals indicative thereof, the detected x-rays being comprised of scattered components and fundamental components, where the fundamental components comprise x-rays which pass directly through the subject without scattering, said first, second, third and fourth distances having a relation such that, when the X-ray focal spot moves on said anode target by said first distance, those areas on said two-dimensional input plate of said X-ray detecting means, on which X-rays having passed through adjacent slits impinge, partially overlap;

data processing means for processing said electrical signals converted by said X-ray detecting means, said data processing means providing processed electrical signals corresponding to said fundamental components of the X-rays having passed through said slits and the subject, including: (1) means for dividing said projected area into a plurality of portions which extend parallel to said second direction in which said slits extend, and (2) means for acquiring electrical signals corresponding to the fundamental components from each of said portions, said fundamental components being those of the X-rays which impinge onto that area on said two-dimensional input plate which are projected from said x-ray focal spot through said slits, said data processing means comprises means for reconstructing an X-ray image based on said electrical signals corresponding to said fundamental components; and image display means for displaying the image reconstructed by said data processing means.

2. An x-rays imaging apparatus according to claim 1 in which said X-ray detecting means comprises an X-ray image intensifier.

3. An X-ray imaging apparatus according to claim 1 in which said X-ray detecting means comprises a camera tube.

4. An X-ray imaging apparatus according to claim 1, in which said data processing means picks up the electrical signals corresponding to said fundamental components and electrical signals corresponding to scattered components appearing on an area outside, but near said projected area on said two-dimensional input plane, said data processing means comprises mean for processing said signals to eliminate the scattered signals.

5. An X-ray imaging apparatus according to claim 1 in which said data processing means comprises means for storing both the electrical signals corresponding to said fundamental components and the electrical signals corresponding to scattered components appearing on an area outside said projected area on said two-dimensional input plate, and comprises further processing means to remove the electrical signals corresponding to scattered components appearing on said outside area so that only the electrical signals corresponding to said fundamental components are provided to said data processing means.

6. An X-ray imaging apparatus according to claim 1, in which said slit plate is a lead plate having through-holes forming said slits.

7. An X-ray imaging apparatus according to claim 1, in which said means for moving the X-ray focal spot is for reciprocally moving said focal spot in a third direction parallel to said first direction in which said focal spot moves, a first frequency, by which said focal spot reciprocally moves in said fist direction, being higher than a second frequency, by which said focal spot moves in said third direction.

8. An X-ray imaging apparatus according to claim 1 wherein said data processing means has means for dividing said projected are into a plurality of continuous portions.

9. A method for perofrming X-ray imaging, comprising the steps of:

generating X-rays using an electron gun which emits an electron beam at an anode target to an X-ray focal spot thereupon;

collimating said X-rays by providing a slit plate separated from the electrion gun, said slit plate formed with a plurality of elongated slits which allow X-rays to pass therethrough and which extend in a first direction;

detecting X-rays with detector means, which have passed through said slit plate and a subject to be X-rayed, the detected x-rays being comprised of scattered components and fundamental components, where the fundamental components comprise x-rays which pass directly through the subject without scattering, moving x-ray focal spot on said anode target in a second direction which is perpendicular to said first direction, so as to form a plurality of x-rays which scan several areas on said detector means, where the scanned areas formed by x-rays passing through adjacent slits partially overlap, converting said detected x-rays to electrical signals;

processing said electrical signals by providing processed electrical signals corresponding to fundamental components of the X-rays having passed through said slits and said subject, said processing occurring by dividing a projected area into a plurality of continuous portions, each of which extend parallel to said first direction in which the slits extend, and acquiring first electrical signals corresponding to said fundamental components from each of the portions;

reconstructing an X-ray image based on said first electrical singals; and displaying the reconstructed image.

* * * * *